United States Patent [19]

Makino et al.

[11] Patent Number: 4,641,331

[45] Date of Patent: Feb. 3, 1987

[54] AUTOMATIC EXPOSURE DEVICE FOR A PANORAMIC X-RAY PHOTOGRAPHING DEVICE

[75] Inventors: Takao Makino, Otsu; Shinichi Osada, Kyoto, both of Japan

[73] Assignee: Kabushiki Kaisha Morita Seisakusho, Kyoto, Japan

[21] Appl. No.: 636,689

[22] Filed: Aug. 1, 1984

[30] Foreign Application Priority Data

Aug. 2, 1983 [JP] Japan ..... 58-142045

[51] Int. Cl.[4] ..... H05G 1/30; H05G 1/32

[52] U.S. Cl. ..... 378/108; 378/39; 378/110; 378/112

[58] Field of Search ..... 378/39, 108, 112, 110

[56] References Cited

U.S. PATENT DOCUMENTS

| | | | |
|---|---|---|---|
| 4,063,099 | 12/1977 | Crassmé | 378/39 |
| 4,119,856 | 10/1978 | Franke | 378/108 |
| 4,333,012 | 6/1982 | Furuichi | 378/108 |

*Primary Examiner*—Craig E. Church
*Assistant Examiner*—T. N. Grigsby
*Attorney, Agent, or Firm*—Koda and Androlia

[57] ABSTRACT

An automatic exposure device for obtaining X-ray pictures with superior quality and constant contrast by feedback of both tube voltage and tube current according to the residual X-ray dose which penetrates the body of a patient. This device is further characterized in that the feedback control is compensatingly done according to the changes in the tube voltage and tube current caused by fluctuations of the power supply.

6 Claims, 4 Drawing Figures

AUTOMATIC EXPOSURE DEVICE FOR A PANORAMIC X-RAY PHOTOGRAPHING DEVICE

BACKGROUND OF THE INVENTION

1. Field of the Invention

The present invention relates to an automatic exposure device for a panoramic X-ray photographing apparatus, and more particularly to a panoramic X-ray photographing device for dental diagnosis.

2. Prior Art

The quality of X-ray photographs taken by an X-ray photographing apparatus is determined by whether X-ray tube current is balanced with X-ray tube voltage or not and is judged by the blackening degree (density) of photograph films. Particularly in a panoramic X-ray photographing apparatus for dental diagnosis, the X-ray dose reaching a film surface varies according to the differences between an adult and a child, between a male and a female and between a foretooth and a molar tooth. As a result, the contrast on the film surface differs from place to place such that a good contrast is obtained at some portions, while at other portions a good contrast can not be obtained because of the blackening degree greatly differing from the optimum value. Although this problem can be solved by adjusting X-ray exposure, prior art had the following drawbacks.

That is, the conventional automatic exposure device controls only the tube voltage or tube current according to penetrated X-ray dose. For example, the invention disclosed in Japanese Patent Publication No. 46640/1982 (hereinafter referred to as the former invention) automatically control the X-ray tube voltage of an X-ray generator according to penetrated X-ray dose while the invention disclosed in Japanese Patent Publication No. 12518/1982 (hereinafter referred to as the latter invention) automatically controls the tube current so that a constant ratio is obtained between the penetrated X-ray dose and film speed. In the case of these inventions, either the tube current or voltage, which is not controlled, must be initially set. This initial value must be fixed or manually adjusted by the operator. Therefore, in the case of the former invention, picture quality is determined only by the X-ray intensity. As a result, the contrast is variable and the picture becomes blurred, preventing proper diagnosis. Furthermore, since the tube current to be fixed is apt to be set high, extra X-rays are radiated to patients. Although the latter invention provides a good contrast, it cannot generate picture quality with a proper X-ray intensity based on the actual bone construction of each patient. To solve this problem, another invention has been proposed, which uses a head securing unit to initially set the tube voltage according to the head size of each patient. In this case, however, the initial value is set without fully considering the actual bone construction of each patient, thus problems are caused in actual practice.

In the case of the invention in which feedback control is applied to the tube voltage or current according to the residual penetrated X-ray dose, accurate and stable control is impossible if the actual tube voltage or current fluctuates is inaccurate even when feedback information is correct. If the power voltage fluctuates or the X-ray tube deteriorates (the X-ray tube cannot perform stable operation permanently but deteriorates after use for an extended period) for example, the actual tube voltage and current also fluctuate and the blackening degree cannot be controlled properly even when the feedback applied, preventing generation of proper X-ray pictures having high repeatability.

SUMMARY OF THE INVENTION

It is therefore an object of the present invention to provide an automatic exposure apparatus which automatically feeds back both the tube voltage and tube current. This object is attained by providing an apparatus which is composed of a means for converting the residual X-ray dose penetrated a patient and an X-ray film into an electrical output, a comparing means for comparing the level of this electrical output with a preset level, a tube voltage feedback element provided at the primary side of a high voltage transformer and a tube current feedback control element provided at the primary side of a filament transformer whereby both the feedback control elements are simultaneously feedback-controlled by the output of the comparing means.

Another object of the present invention is to provide an automatic exposure apparatus which can cope with the fluctuation of the power voltage. This object is attained by providing an apparatus comprising a means for converting the residual X-ray dose penetrated a patient and an X-ray film into an electrical output, the first comparing means for comparing the level of this electrical output with a preset level, the second comparing means for comparing the output level of the first comparing means with the actual tube voltage and current applied to the X-ray tube, a tube voltage feedback control element provided at the primary side of the high voltage transformer and a tube current feedback control element provided at the primary side of the filament transformer, wherein both the feedback control elements are simultaneously feedback-controlled by the output of the second comparing means.

BRIEF DESCRIPTION OF THE DRAWINGS

The above objects will become more apparent when preferred embodiments of the present invention are considered in connection with the drawings.

DETAILED DESCRIPTION OF THE INVENTION

Figure 1:
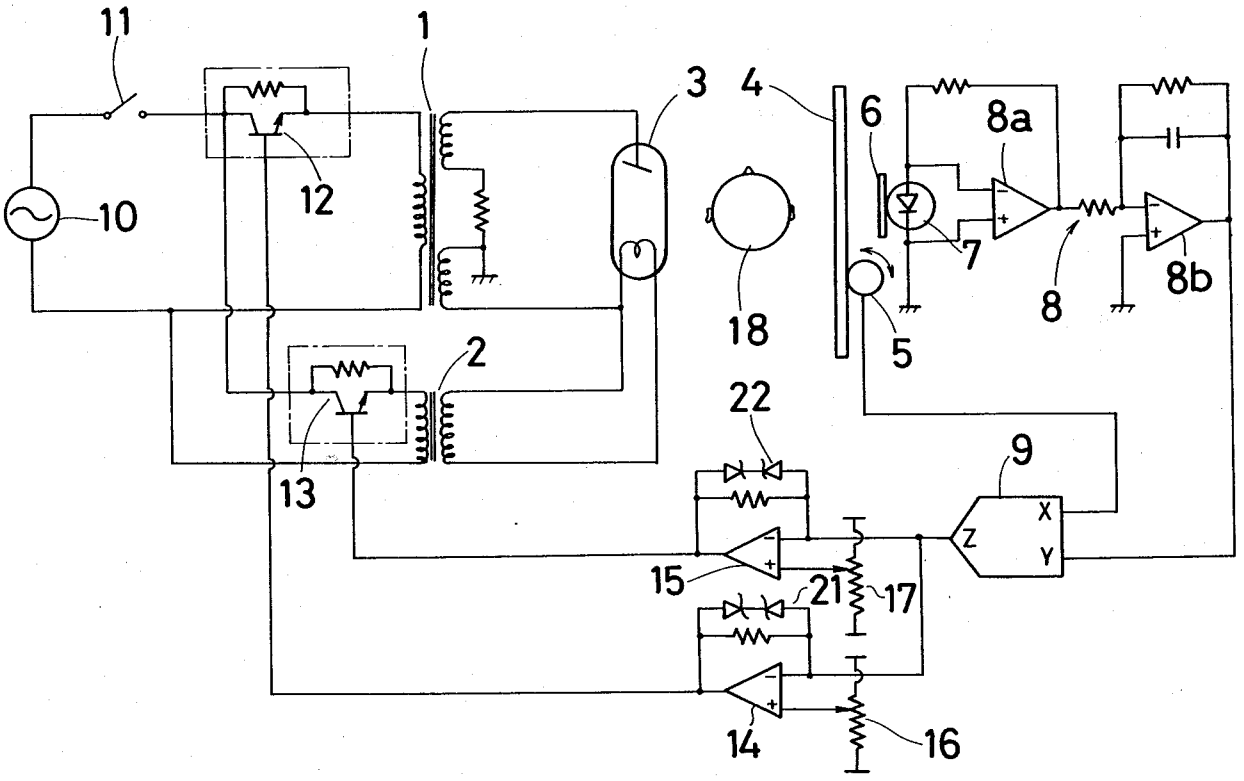
FIG. 1 is a circuit diagram of the automatic exposure apparatus of the first embodiment of the present invention.

In FIG. 1, high voltage devices, i.e. a high voltage transformer 1, a filament transformer 2 and an X-ray tube 3 are accommodated in an X-ray radiation head (not shown). An X-ray film 4 is placed opposite the head. The feed speed of the film 4 is detected as an electrical signal by a low-speed tachometer 5. A light-emitting plate 6 is activated by the X-ray penetrating the film 4 and emits light. An electrical signal corresponding to the luminance of the light-emitting plate 6 is output from a photoelectric convertor 7. An amplifier circuit 8, composed of two amplifiers **8*a* and 8*b*, amplifies the output signal of the photoelectric converter 7. The output of the low-speed tachometer 5 and the output of the photoelectric convertor 7, which has passed the amplifier circuit 8**, are input to an operation circuit 9. The operation circuit 9 outputs a ratio signal ($Z=y/x$) of both output signals. On the head side, the primary sides of the high voltage transformer 1 and the filament transformer 2 are connected to an AC power supply 10 via an ON/OFF switch 11. Feedback control transistors 12 and 13 are provided at the respective primary sides. The base biases of the feedback control transistors 12 and 13 are changed to apply feedback control to the high voltage transformer 1 and the filament transformer 2. For this purpose, the output of the operation circuit 9 is fed to the tube voltage control comparator 14 and the tube current control comparator 15, and the base biases are adjusted by these comparators 14 and 15. Ratio setting devices 16 and 17 are used to set the ratio signal Z. Zenor diodes function as limiters (voltage range setting devices) 21 and 22.

To operate this apparatus, first determine the appropriate ratio between the tube voltage and current. More specifically, fabricate the circuit shown in FIG. 1 and adjust the ratio setting devices 16 and 17 so that the tube voltage and current have a specific relationship. For example, when the tube voltage is 60 kV, a tube current of 5 mA flows, and when the tube voltage is 80 kV, a tube current of 10 mA flows. The ratio should be determined according to clinical data.

This apparatus functions as described below. When the X-ray tube 3 is turned on, X-rays penetrate the teeth of a patient 18 and are sensed by the film 4 so that an image of the teeth is formed on the film 4. On the other hand, the residual X-ray dose penetrating the film 4 activates the light-emitting plate 6. Since the luminance of the light-emitting plate 6 is proportional to the X-ray intensity, the photoelectric converter 7 outputs an electrical signal corresponding to the X-ray intensity. This signal is input to the operation circuit 9 through the amplifier circuit 8. The film 4 is fed by a feeding means (not shown) so that panoramic photographing is done. The low-speed tachometer 5 detects the film feed speed and outputs an electrical signal. This electrical signal is also input to the operation circuit 9. The operation circuit 9 feeds a signal ($Z=y/x$) having a ratio between both input signals to the comparators 14 and 15. The comparator 14 compares the ratio value input from the operation circuit 9 and the ratio value preset by the ratio setting device 16. In the same way, the comparator 15 compares the ratio value input from the operation circuit 9 and the ratio value preset by the ratio setting device 17. These comparators 16 and 17 change the base biases of the feedback control transistors 12 and 13 and drive the high voltage transformer 1 and filament transformer 2 so that the ratio values equal the corresponding preset ratio values, thereby altering the application voltage and the filament current of the X-ray tube 3 to simultaneously feed back the tube voltage and current so that the output ($Z=z/x$) of the operation circuit 9 is constant. Even when the tube voltage and current change due to feedback control, a specific relationship between the tube voltage and current is maintained (a ratio of 60 kV to 5 mA for example) as a matter of course.

By maintaining the ratio Z constant, the best picture and the contrast are obtained. However, the control ranges of the tube voltage and current have limits and cannot be increased or decreased without restrictions. More specifically, the upper limit of the control range is determined by the maximum rating of the apparatus, and the lower limit is determined by the limit of soft X-ray radiation exposure to the patient. The limiters 21 and 22 are used to set the upper and lower limits, and function to perform feedback control through the comparators 14 and 15 so that the control range is maintained between the upper and lower limits.

Figure 2:
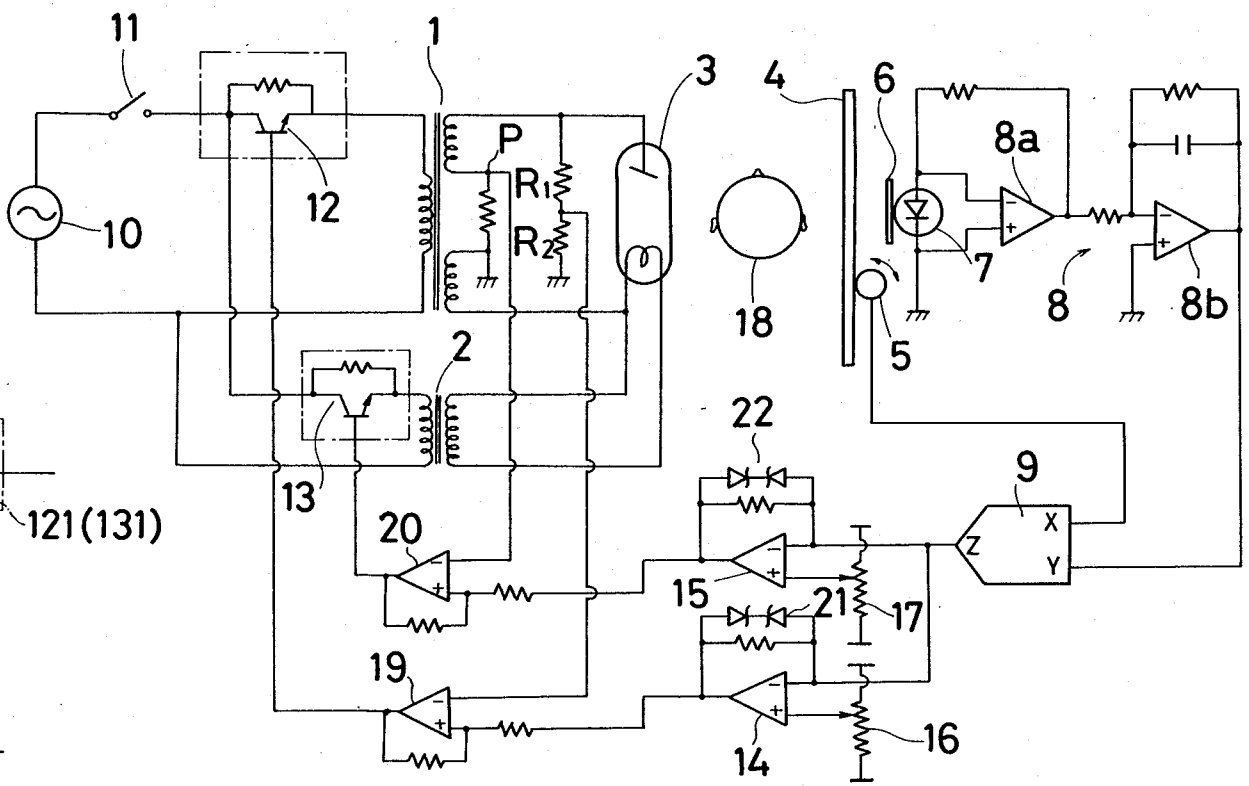
FIG. 2 is a circuit diagram of the second embodiment of the present invention.

FIG. 2 shows a circuit embodied to cope with the power voltage fluctuation described in the beginning. The tube voltage actually applied to the X-ray tube 3 in the head is delivered via division resistors R1 and R2. The delivered voltage is compared with the output of the tube voltage control comparator 14 by the comparator 19. In addition, the tube current actually flowing in the X-ray tube 3 is delivered from the secondary point P of the secondary side of the high voltage transformer 1. This delivered current is compared with the output of the tube current control comparator 15 by the comparator 20. These comparison outputs are used to change the base biases of the feedback control transistors 12 and 13. More specifically, the comparators 19 and 20 use the outputs of the comparators 14 and 15 provided in the previous stage as the reference signals to compare them with the actual tube voltage and current of the X-ray tube 3. When the actual tube voltage and current change due to fluctuation of the power voltage, the feedback signals from the comparators 14 and 15 are compensated for so that X-ray photographing is done regardless of fluctuation of the power voltage.

Figure 3:
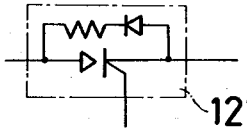
FIGS. 3 and 4 show other embodiments of the tube voltage feedback control element and the tube current feedback control element of the present invention.
Figure 4:
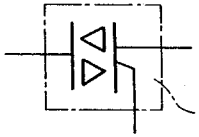

In the embodiments shown in FIGS. 1 and 2, feedback is done using the ratio between the film feed speed and the penetrated X-ray dose. However, only the penetrated X-ray dose can be compared by the comparators 14 and 15 as a matter of course. Furthermore, instead of the transistors 12 and 13 used in the embodiments shown in FIGS. 1 and 2 as the tube voltage feedback control element and the tube current feedback control element, other voltage control elements, such as thyristors 121, 131 and triacs 122, 132, as shown in FIGS. 3 and 4, can also be used if they can control the voltages of the feedback circuits. With this invention, both the tube voltage and current are fed back simultaneously according to the residual X-ray dose which penetrated the patient, as clearly understood by the above description. Therefore, X-ray pictures with superior quality and constant contrast can be obtained. In addition, this invention can eliminate one of the initial settings (the tube voltage or current) and troublesome manual adjustment. Rephotographing due to improper settings can also be eliminated. Furthermore, this invention is advantageous since photographing is done according to the bone construction of individual patients.

Moreover, since the feedback amount of the tube voltage and current are compared with the actual tube voltage and current applied to the X-ray tube, and the feedback amounts are compensated for according to the change of the actual tube voltage and current, feedback control is done stably and superior X-ray pictures with high repeatability can be obtained.

Having described our invention as related to the embodiments shown in the accompanying drawings, it is our intention that the invention is not limited by any of the details of the description, unless otherwise specified, but rather be construed broadly within its spirit and scope as set out in the accompanying claims.

We claim:

1. An automatic exposure device for a panoramic X-ray photographing apparatus comprising a means for converting a residual X-ray dose penetrating a patient and an X-ray film into an electrical output, a comparing means for comparing the level of said electrical output with a preset level, a tube voltage feedback control element provided at the primary side of a high voltage transformer, a tube current feedback control element provided at the primary side of a filament transformer, wherein both feedback control elements are simultaneously feedback-controlled by the output of said comparing means, and a means for detecting the feed speed of the X-ray film and converting the speed into an electrical output so that said electrical output of said residual penetrated X-ray dose and the electrical output of said feed speed may be simultaneously inputted to said comparing means and that the ratio of the two outputs may be delivered as the output of said comparing means.

2. An automatic exposure device for a panoramic X-ray photographing apparatus comprising a means for converting the residual X-ray dose penetrating a patient and an X-ray film into an electrical output, first comparing means for comparing the level of said electrical output with a preset level, second comparing means for comparing the output level of the first comparing means with the actual tube voltage and current applied to an X-ray tube, a tube voltage feedback control element provided at the primary side of a high voltage transformer and a tube current feedback control element provided at the primary side of a filament transformer, wherein both feedback control elements are simultaneously feedback-controlled by the output of said second comparing means.

3. An automatic exposure device as defined in claim 2, wherein said exposure device further comprises a means for detecting the feed speed of the X-ray film and converting the speed into an electrical output so that the electrical output of said residual penetrated X-ray dose and the electrical output of said feed speed may be simultaneously input to said first comparing means and that the ratio of the two outputs may be delivered as the output of said first comparing means.

4. An automatic exposure device as defined in claim 1, 2 or 3, wherein transistors are used for said tube voltage feedback element and said tube current control element.

5. An automatic exposure device as defined in claim 1, 2 or 3, wherein thyristors are used for said tube voltage feedback element and said tube current control element.

6. An automatic exposure device as defined in claim 1, 2 or 3, wherein triacs are used for said tube voltage feedback element and said tube current control element.

* * * * *